United States Patent [19]

Wilkes et al.

[11] Patent Number: 4,768,446

[45] Date of Patent: Sep. 6, 1988

[54] COAL COMBUSTION SYSTEM

[75] Inventors: Colin Wilkes, Lebanon; Hukam C. Mongia, Carmel; Peter C. Tramm, Indianapolis, all of Ind.

[73] Assignee: General Motors Corporation, Detroit, Mich.

[21] Appl. No.: 36,231

[22] Filed: Apr. 9, 1987

[51] Int. Cl.[4] ..... F23C 1/10

[52] U.S. Cl. ..... 110/262; 60/39.464; 110/214; 110/215; 110/216; 110/229; 110/233; 110/264; 110/266

[58] Field of Search ..... 110/260, 261, 262, 263, 110/264, 265, 266, 214–215, 216, 229, 230, 210–211; 60/39.464; 431/9

[56] References Cited

U.S. PATENT DOCUMENTS

| | | | |
|---|---|---|---|
| 2,651,176 | 9/1953 | Yellott | 60/39.46 |
| 2,861,423 | 11/1958 | Jerie et al. | 60/39.46 |
| 4,089,631 | 5/1978 | Giles | 431/9 |
| 4,164,846 | 8/1979 | Moskowitz et al. | 110/263 X |
| 4,338,782 | 7/1982 | Marchand | 60/39.46 |
| 4,357,152 | 11/1982 | Duske et al. | 110/215 X |
| 4,479,442 | 10/1984 | Itse et al. | 110/264 X |
| 4,515,093 | 5/1985 | Beardmore et al. | 110/215 X |
| 4,660,478 | 4/1987 | Sheppard et al. | 110/264 |

*Primary Examiner*—Steven E. Warner

*Attorney, Agent, or Firm*—Saul Schwartz

[57] ABSTRACT

In a coal combustion system suitable for a gas turbine engine, pulverized coal is transported to a rich zone combustor and burned at an equivalence ratio exceeding 1 at a temperature above the slagging temperature of the coal so that combustible hot gas and molten slag issue from the rich zone combustor. A coolant screen of water stretches across a throat of a quench stage and cools the combustible gas and molten slag to below the slagging temperature of the coal so that the slag freezes and shatters into small pellets. The pelletized slag is separated from the combustible gas in a first inertia separator. Residual ash is separated from the combustible gas in a second inertia separator. The combustible gas is mixed with secondary air in a lean zone combustor and burned at an equivalence ratio of less than 1 to produce hot gas motive at temperature above the coal slagging temperature. The motive fluid is cooled in a dilution stage to an acceptable turbine inlet temperature before being transported to the turbine.

4 Claims, 3 Drawing Sheets

COAL COMBUSTION SYSTEM

This invention herein described was made in the course of work under a contract or subcontract thereunder with the Department of Energy.

BACKGROUND OF THE INVENTION

1. Field of the Invention

This invention relates generally to combustion systems and, more particularly, to a gas turbine engine combustion system for burning pulverized coal and for separating slag and ash from the products of combustion.

2. Description of the Prior Art

As a fuel for gas turbine engines, coal is attractive because it is available in secure and abundant quantities. Its gaseous products of combustion, however, typically are high in oxides of nitrogen ($NO_x$) and include entrained slag and ash harmful to turbine components. Prior proposals for burning fuels with high fuel-bound nitrogen content, such as coal derived oils, have included rich-quench-lean (RQL) combustors where combustion takes place in rich and lean stages separated by quench stage in which the combustion products of the rich stage are cooled by addition of cold air. In addition, the injection of water or steam into products of combustion from a combustor has been found to have a positive effect in controlling $NO_x$. In prior coal fueled gas turbine engines, ash removal has typically been achieved by circulating the products of combustion through a series of cyclone separators between the combustor and the turbine. A gas turbine engine combustion system according to this invention combines RQL combustion of powdered or slurried coal with a simple and efficient ash removal system using water or steam and, therefore, represents an improvement over prior coal burning combustion systems.

BRIEF SUMMARY OF THE INVENTION

This invention is a new and improved coal combustion system particularly suited for a gas turbine engine. In the combustion system according to this invention, powdered or slurried coal is burned in a primary air supply in a first or rich zone combustor at a temperature above the slagging temperature of the coal. The fast flowing effluent of the rich zone combustor, a mixture of molten slag and combustible gases such as carbon monoxide and hydrogen, passes through a curtain of water or steam in a quench stage which substantially instantly freezes the molten slag and reduces the temperature of the gases. The thermal shock of freezing causes the slag to shatter into relatively small pellets which collect in a simple inertia separator below the quench stage. The combustible gases with some entrained residual ash flow in a tortuous path through the inertia separator and then into a cyclone separator where up to in excess of 99% of the entrained ash above 10 micrometers in size is removed. From the cyclone separator, the ash-free combustible gases enter a second or lean zone combustor where mixture with a supply of secondary air initiates spontaneous combustion which raises the gas temperature back above the coal slagging temperature. Dilution air is added down stream of the lean zone combustor to reduce the gas temperature to a lower turbine inlet temperature.

DESCRIPTION OF PREFERRED EMBODIMENTS

Figure 1:
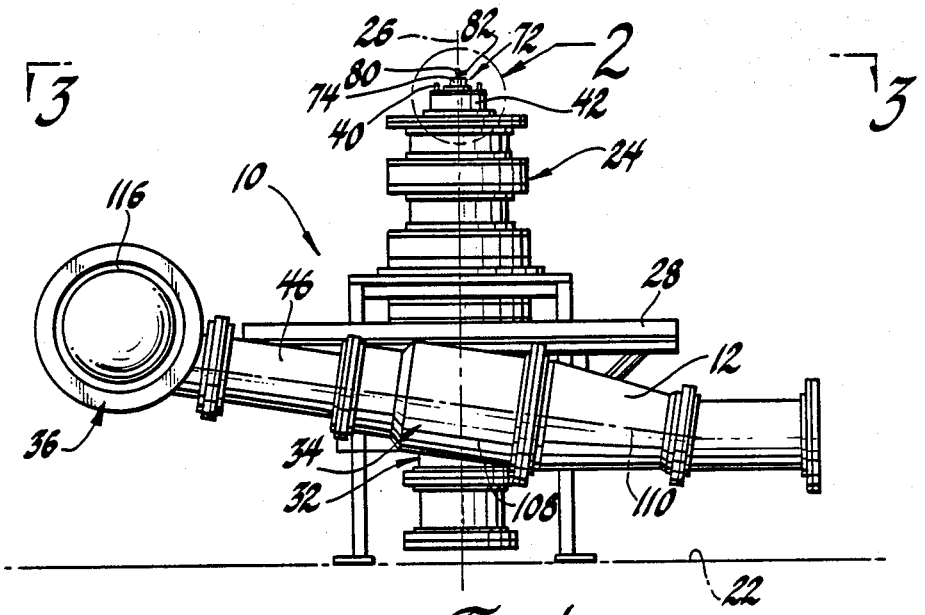
FIG. 1 is an elevational view of a coal burning combustion system according to this invention.
Figure 3:
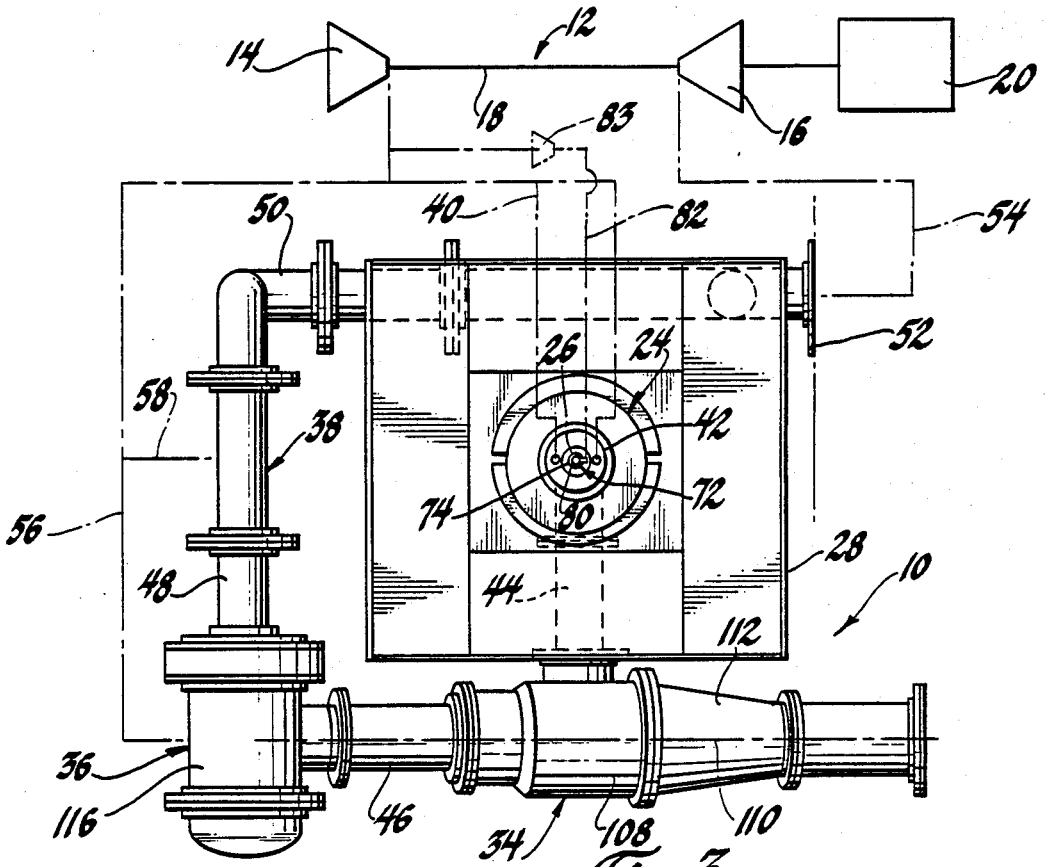
FIG. 3 is view taken generally along the plane indicated by lines 3—3 in FIG. 1 and including a schematic illustration of a gas turbine engine associated with the combustion system.

Referring now to FIGS. 1 and 3, a coal burning combustion system 10 according to this invention operates as an external combustor for a schematically illustrated gas turbine engine 12, FIG. 3. The engine 12, illustrated as a stationary industrial engine but adapted for mobile application such as in a locomotive, includes a compressor 14 and a turbine 16 connected to the compressor by a shaft 18. The turbine 16 drives the compressor 14 and also a schematically illustrated load 20 such as an electric generator.

The combustion system 10 is situated on a horizontal base surface 22 and includes a generally cylindrical rich zone combustor 24 centered on a vertical axis 26. A structural support platform 28 surrounds the rich zone combustor 24 and rests on the base surface 22. The combustion system 10 further includes a quench stage 30, FIG. 4, below and rigidly attached to the rich zone combustor, an inertia separator 32 below and rigidly connected to the quench stage, a cyclone separator 34, a lean zone combustor 36, and a dilution stage 38, FIG. 3. A schematically illustrated primary air duct 40, FIG. 3, extends from the compressor 14 to an inlet housing 42 on top of the rich zone combustor 24. A first duct 44 connects the inertia separator 32 to the cyclone separator 34. A second duct 46 connects the cyclone separator 34 to the lean zone combustor 36. A third duct 48 connects the lean zone combustor 36 to the dilution stage 38 and a fourth duct 50, FIG. 3, extends from the dilution stage to a connecting flange 52 whereat a schematically illustrated fifth duct 54 to the turbine 16 is attached. A secondary air duct 56 branches from the primary air duct 40 to the lean zone combustor 36 and a dilution air duct 58 similarly branches from the primary air duct 40 to the dilution stage 38.

Figure 4:
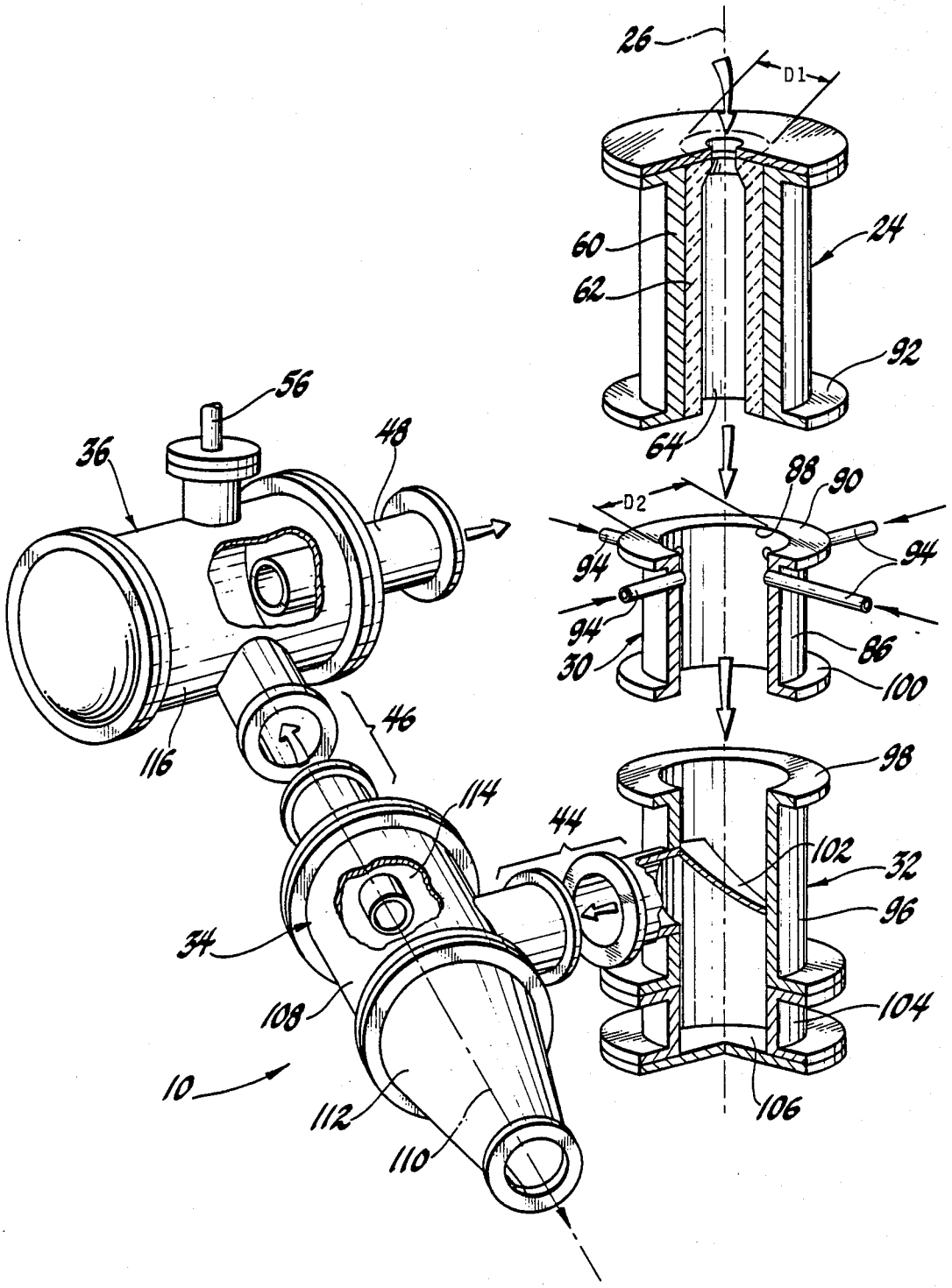
FIG. 4 is a partially broken away exploded perspective view of a coal burning combustion according to this invention.

As seen best in FIG. 4, the rich zone combustor 24 includes a cylindrical outer shell 60 and an inner shell 62 of high temperature resistant castable refractory. The inner shell 62 has an inside diameter D1 and opens downwardly through a circular opening 64 of the same diameter.

Figure 2:
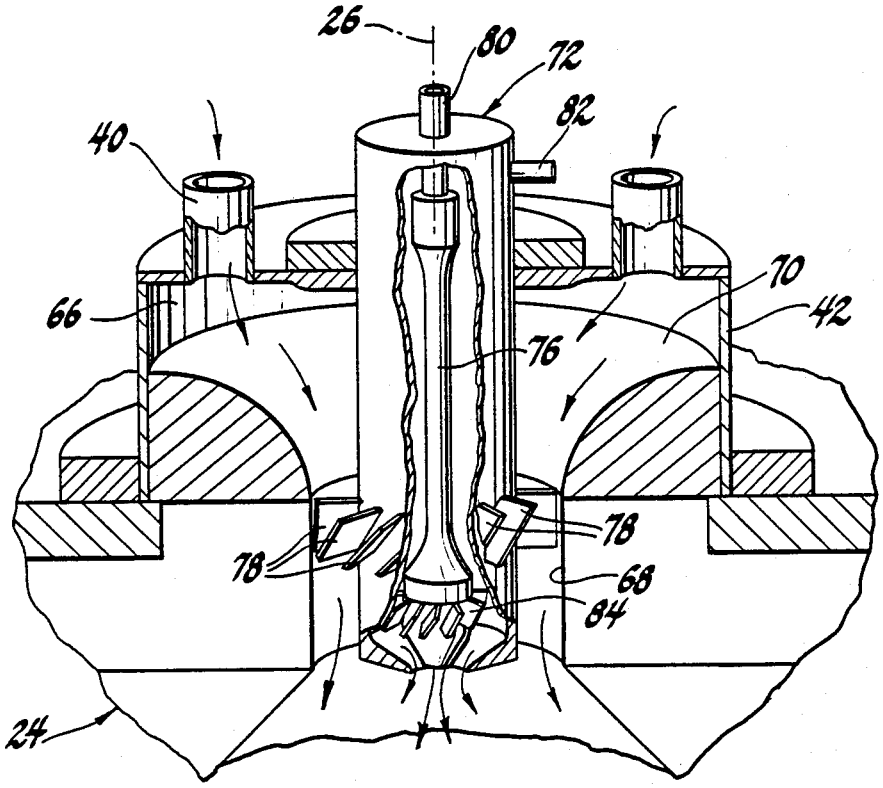
FIG. 2 is an enlarged broken away view of the portion of FIG. 1 within the circle "2" in FIG. 1.

As seen best in FIG. 2, the interior of the inlet housing 42 on top of the rich zone combustor 24 defines an inlet chamber 66 which opens through a cylindrical passage 68 at the center of a bell mouth 70 into the center of the inner shell 62 of the rich zone combustor. A nozzle 72 is centrally mounted on the inlet housing 42 and includes an outer body 74 and an inner body 76 within the outer body. The outer body 74 projects into the passage 68 and carries a plurality of outside vanes 78 which impart a swirl to primary air flowing from inlet chamber 66 into the rich zone combustor 24. A fuel supply conduit 80 connects to the nozzle inner body 76 outside the inlet housing 66 and transports pulverized coal in slurry or powdered form to the lower end of the inner body. An atomizing air duct 82, FIGS. 2 and 3, branches from the primary air duct 40 and is connected to the space between the inner and outer bodies 76 and 74 of the nozzle. Atomizing air from the compressor 14 is boosted in pressure by a boost compressor 83 in the duct 82 and flows downward into the rich zone combustor 24 through a plurality of atomizing vanes 84 on the inner body. The swirling atomizing air mixes with and disperses the pulverized coal issuing from the end of the inner body. The nozzle 72 is representative and forms no part of this invention.

The quench stage 30 includes a cylindrical housing 86 having a inner wall 88 which defines a throat of the quench stage. The inner wall has a diameter D2 which exceeds diameter D1 of the inner shell 62 of the rich zone combustor 24. The throat may be lined with refractory or the quench stage may be water cooled. A flange 90 on the quench stage provides rigid connection of the latter to a corresponding flange 92 on the rich zone combustor 24 whereby the quench stage is aligned on the vertical axis 26. A plurality of coolant supply pipes 94 connect to a corresponding plurality of nozzles on the quench stage adapted to direct horizontal sprays of coolant across the throat of the quench stage. The nozzles are arranged such that a curtain of coolant stretches completely across the throat in a plane perpendicular to the axis 26. A preferable coolant is water but steam or other inert material having a high heat capacity can be employed.

The inertia separator 32 has a cylindrical body 96 with a flange 98 at the top whereby the separator is rigidly attached to a flange 100 at the bottom of the quench stage 30. A schematically illustrated baffle 102 is disposed in the separator 32 and forecloses direct line-of-sight communication between the top of the separator and the opening of the first duct 44 through the cylindrical body 96 of the separator. A slag trap 104 below the baffle 102 is closed by a cover 106 which represents a lock hopper or other conventional apparatus for removing solids from a high pressure environment without pressure loss.

The cyclone separator 34 has a cylindrical center body 108 aligned on a generally downwardly sloping axis 110, FIG. 1, a conical end body 112 rigidly attached to one end of the center body 108, and an end wall 114 closing the opposite end of the center body 108. The inner surfaces of the center and end bodies 108 and 112 and the end wall 114 are preferably refractory lined but may be constructed of high temperature alloy. The first duct 44 opens into the center body 108 generally tangent to the inside surface of the refractory lining of the latter. The second duct 46 is aligned on the axis 110 and extends through the end wall 114 whereby the inner end of the duct is suspended within the center body 108.

The lean zone combustor 36 is preferably, but not necessarily, of the cyclonic type and includes a cylindrical housing 116 which is closed at both ends. The distal end of the second duct 46 opens into the interior of the housing 116 generally tangent to the inside wall thereof, which is also lined with a castable refractory. The secondary air duct 56 likewise opens into the housing 116 of the lean zone combustor 36 and may be arranged to increase turbulence in the latter by discharging secondary air counter to the gaseous effluent from second duct 46. The third duct 48 is supported on one end wall of the housing with an inner end suspended within the housing 116.

The dilution stage 38, illustrated only in FIG. 3, is essentially a cylinder into which the third and fourth ducts 48 and 50 open from opposite ends. The dilution stage 38 is peculiar to the gas turbine application of the combustion system according to this invention because of limitations on the temperature of the hot gas motive fluid which may be introduced into the turbine 16 through the fourth and fifth ducts 50 and 54. In other applications, the dilution stage could be eliminated and the fourth duct 50 connected directly to the downstream consuming device.

With particular reference to FIG. 4, the steady state operation of the combustion system 10 is described as follows. The numerical values stated herein are estimates for an engine capable of producing about 6500 horsepower. The compressor 14 supplies about 8.21 pounds per second (PPS) of primary air to the inlet chamber 66. Pulverized coal in a coal/water slurry is transported to the nozzle 72 at a rate of about 2.59 PPS. In the hot atomizing air from the compressor, the water content of the slurry is evaporated and the coal dispersed in the rich zone combustor 24 where combustion takes place in a fuel rich environment characterized by an equivalence ratio of about 1.6. This combustion occurs at a temperature of about 2600° F. which is well above the slagging temperature of the coal. Accordingly, the effluent from the rich zone combustor 24 through the circular opening 64 is a vertically down, fast moving, continuous stream of combustible gases including carbon monoxide and hydrogen, with entrained droplets of molten slag. In addition to the entrained slag, some slag may collect on the inner shell 62 and drip down through the circular opening 64.

As the effluent from the rich zone combustor 24 enters the throat of the quench stage 30, it must traverse the curtain of water being sprayed by the nozzles at a rate of about 2 PPS. Because the diameter of the circular opening 64 in the rich zone combustor 24 is smaller than the diameter D2 of the throat of the quench stage 30, all of the molten slag, including the portion dripping down the surface of the inner shell 62, passes through the water curtain without attaching itself to the wall of the quench stage. Upon contact with the water, the temperature of the gases and the molten slag drops to about 1700° F., which is below the slagging temperature of the coal, so that the slag freezes. The thermal shock of quick freezing shatters the solidified slag into pellets having diameters of on the order of 0.2 inch. In addition, some lighter residual ash forms and is entrained in the gas stream which proceeds vertically down along with the slag pellets toward the inertia separator 32.

In the inertia separator 32, the combustible gases, the residual ash and the dry slag pellets impinge on the baffle 102 and are deflected by the latter. The gases and relatively light entrained ash proceed around the baffle and then into the first duct 44 for transit to the cyclone separator 34. The heavier slag pellets, however, are captured in the slag trap 104 and are extracted continuously or at convenient intervals.

The approximate 12.8 PPS stream of combustible gases in the first duct enters the cyclone separator 34 and swirls around the inner surface of the center body 108. The entrained residual ash is separated from the combustible gases to the extent that on the order of 99.85% of ash particles in excess of 10 micrometers in size are removed before the combustible gases enter the second duct 46. The residual ash and any slag removed in the cyclone separator 34 migrates to the small end of the end body 110 where it is easily discharged.

The substantially ash-free combustible gas stream flows into the lean zone combustor 36 through second duct 46. Secondary air at a rate of about 5.04 PPS is supplied to the lean zone combustor 36 through the secondary air duct 56 in a fashion to maximize turbulence in the lean zone combustor. The secondary air initiates spontaneous combustion of the combustible gases at an equivalence ratio of about 0.44 whereby all of the combustible constituents are consumed. This combustion produces a continuous stream of hot gas motive fluid at about 2800° F.

Because 2800° F. is above conventional turbine inlet temperatures, about 16.85 PPS of dilution air is supplied to the continuous stream of hot gas motive fluid in the dilution stage 38. Mixture with the cooler dilution air reduces the gas temperature to an acceptable 2035° F., which is still above the slagging temperature of the coal. The hot gas motive fluid is then introduced into the turbine 16 through the fourth and fifth ducts 50 and 54.

Figure 5:
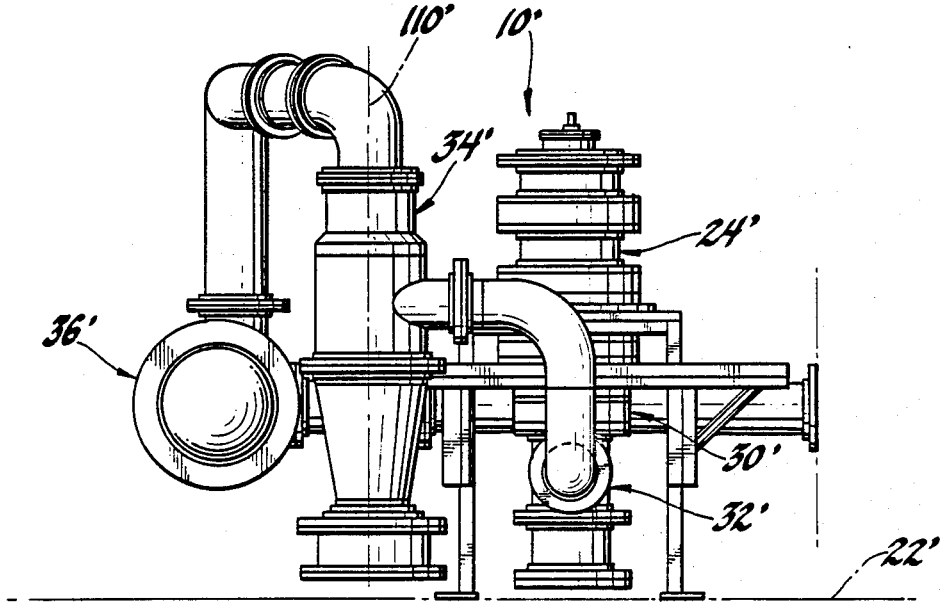
FIG. 5 is similar to FIG. 1 but showing a modified version of a coal burning combustion system according to this invention.

In FIG. 5, a modified combustion system 10' according to this invention is illustrated. The combustion system 10' has a rich zone combustor 24', a quench stage 30', an inertia separator 32', a cyclone separator 34' and a lean zone combustor 36' corresponding, respectively, to the rich zone combustor 24, quench stage 30, inertia separator 32, cyclone separator 34 and lean zone combustor 36 in the afore-described combustion system 10. In the modified combustion system 10', however, the cyclone separator 34' is centered about a vertical axis 110' whereby removal of residual ash from the cyclone separator 34' is improved and the space requirement on a base surface 22' may be reduced.

The embodiments of the invention in which an exclusive property or privilege is claimed are defined as follows:

1. In combination with a source of compressed air and a source of pulverized coal in one of a dry powder form and a liquid slurry form, a coal burning combustion system comprising:

a rich zone combustor, means connecting said rich zone combustor to said source of compressed air and to said source of pulverized coal, said coal being burned in a primary portion of said compressed air in said rich zone combustor at an equivalence ratio exceeding 1 and at a temperature exceeding the slagging temperature of said coal so that a continuous stream of combustible hot gases and molten slag issues from said rich zone combustor, a quench stage connected to said rich zone combustor having a throat portion therein receiving said continuous stream of combustible hot gases and molten slag, means on said quench stage defining a coolant curtain stretching across said throat portion and intercepting said continuous stream of combustible hot gases and molten slag, said coolant curtain reducing the temperature of said continuous stream of combustible hot gases and molten slag to below the slagging temperature of said coal so that said molten slag solidifies and shatters into a plurality of dry slag pellets entrained in said stream of combustible hot gases along with a quantity of residual ash, a first inertia separator means connected to said quench stage receiving said continuous stream of combustible hot gases with said entrained residual ash and dry slag pellets and separating substantially all of said dry slag pellets from said combustible hot gases, a second inertia separator means connected to said first inertia separator means receiving said continuous stream of combustible hot gases with said entrained residual ash therein and separating substantially all of said residual ash from said combustible hot gases, a lean zone combustor stage connected to said second inertia separator means and to said source of compressed air operative to mix said combustible hot gases and a secondary portion of said compressed air to initiate spontaneous combustion of said combustible hot gases at an equivalence ratio of less than 1, said spontaneous combustion generating a continuous stream of substantially ash-free hot gas motive fluid at a temperature exceeding the slagging temperature of said coal, and duct means connected to said lean zone combustor for transporting said hot gas motive fluid to a consuming device.

2. The coal burning combustor recited in claim 1 wherein said coolant curtain is a screen of water sprayed from a plurality of nozzles mounted on said quench stage.

3. The coal burning combustor recited in claim 1 wherein said coolant curtain is a screen of steam sprayed from a plurality of nozzles mounted on said quench stage.

4. In combination with a source of pulverized coal in one of a dry powder form and a liquid slurry form and a gas turbine engine having a compressor supplying compressed air and a turbine connected to said compressor, a coal burning combustion system for said gas turbine engine comprising:

a rich zone combustor including a generally cylindrical combustion chamber centered on a vertical axis and a circular discharge from said combustion chamber having a predetermined first diameter, means connecting said rich zone combustion chamber to said compressor and to said source of pulverized coal, said coal being burned in a primary portion of said compressed air in said rich zone combustion chamber at an equivalence ratio exceeding 1 and at a temperature exceeding the slagging temperature of said coal so that a continuous stream of combustible hot gases and molten slag issues in a downward direction through said circular discharge, a quench stage connected to said rich zone combustor including a cylindrical throat centered on said vertical axis having a predetermined second diameter exceeding said first diameter and receiving said continuous stream of combustible hot gases and molten slag, a plurality of nozzles on said quench stage connected to a source of water and spraying said water in a pattern across said cylindrical throat whereby a coolant curtain is defined stretching across said quench stage throat in a plane perpendicular to said vertical axis intercepting said continuous stream of combustible hot gases and molten slag, said coolant curtain reducing the temperature of said continuous stream of combustible hot gases and molten slag to below the slagging temperature of said coal so that said molten slag solidifies and shatters into a plurality of dry slag pellets entrained in said stream of combustible hot gases along with a quantity of residual ash, a first inertia separator means aligned on said vertical axis below and connected to said quench stage receiving said continuous stream of combustible hot gases with said entrained residual ash and dry slag pellets and separating substantially all of said dry slag pellets from said combustible hot gases, a second inertia separator means connected to said first inertia separator means receiving said continuous stream of combustible hot gases with said entrained residual ash therein and separating substantially all of said residual ash from said combustible hot gases, a lean zone combustor connected to said second inertia separator means and to said source of compressed air operative to mix said combustible hot gases and a secondary portion of said compressed air to initiate spontaneous combustion of said combustible hot gases at an equivalence ratio of less than 1, said spontaneous combustion generating a continuous stream of substantially ash-free hot gas motive fluid at a temperature exceeding the slagging temperature of said coal, a dilution stage connected to said lean zone combustor and to said compressor receiving and mixing said continuous stream of hot gas motive fluid with a dilution portion of said compressed air to reduce the temperature of said continuous stream of hot gas motive fluid to a predetermined turbine inlet temperature above the slagging temperature of said coal, and duct means connected to said dilution stage for transporting said continuous stream of hot gas motive fluid to said turbine.

* * * * *